US006327987B1

(12) United States Patent
Takeuchi et al.

(10) Patent No.: US 6,327,987 B1
(45) **Date of Patent: *Dec. 11, 2001**

(54) METHOD FOR SETTING AND ATTACHING BUTTONS AND POCKETS IN PLACE ON UPPER GARMENT AND METHOD FOR PRODUCING THE UPPER GARMENT

(75) Inventors: Michiko Takeuchi, Saitama-ken; Keisuke Inoue, Chiba-ken; Sakae Uchida, Saitama-ken; Gensai Murayama, Saitama-ken; Mituyoshi Nirayama, Saitama-ken; Yuichi Hasegawa, Saitama-ken, all of (JP)

(73) Assignee: Hanabishi Housei Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/906,002

(22) Filed: Aug. 4, 1997

(30) Foreign Application Priority Data

Aug. 6, 1996 (JP) ..... 8-207068
Jun. 30, 1997 (JP) ..... 9-173540

(51) Int. Cl.[7] ..... A41H 43/00
(52) U.S. Cl. ..... 112/475.15; 2/96
(58) Field of Search ..... 112/475.15, 475.14, 112/475.09, 108, 109, 110, 111, 112, 104, 470.03; 2/243.1, 93, 96, 74, 85, 105

(56) References Cited

U.S. PATENT DOCUMENTS 3,823,420 * 7/1974 Breier ..... 2/247
4,807,547 * 2/1989 Sato ..... 112/112
4,865,309 * 9/1989 Beasock et al. ..... 112/470.03 X
5,088,428 * 2/1992 Frye ..... 112/112 X

* cited by examiner

*Primary Examiner*—Peter Nerbun
(74) *Attorney, Agent, or Firm*—Armstrong, Westerman, Hattori, McLeland & Naughton, LLP

(57) ABSTRACT

When producing men's/women's jackets of every kind of length to order of a customer, front buttons and waist pockets are set and attached in well-balanced positions, while maintaining a position of a waist shape for the jacket, by defining an upper part of a back length line as a center back waist length and its lower part as a hip length (below waist) respectively and reflecting a value of the center back waist length in pattern design, setting a top one of the front buttons in a position a prescribed length above the back length line according to the center back waist length or a prescribed length below the back length line according to the hip length, and setting a bottom one of the front buttons and waist pockets in positions a prescribed length below the back length line according to the hip length. In the women's jacket, the center back waist length ranges from 34–45 cm and the hip length ranges from 15–38 cm, the top button is set and attached in a position 1.5–14.0 cm above the back length line, or parallel to or 3.0 cm above the waist pockets which are positioned below the back length line, the bottom button is set and attached in a position 7–10.5 cm below the back length line according to the hip length, and the waist pockets are set and attached in positions 4.5–6.5 cm below the back length line according to the hip length. In addition, the women's jacket is produced with front buttons and waist pockets being attached in well-balanced positions as described above in accordance with an easy-order-making production system.

21 Claims, 5 Drawing Sheets

METHOD FOR SETTING AND ATTACHING BUTTONS AND POCKETS IN PLACE ON UPPER GARMENT AND METHOD FOR PRODUCING THE UPPER GARMENT

BACKGROUND OF THE INVENTION

1. Field of the Invention

The present invention relates to a method for setting and attaching a button or buttons and a pocket or pockets in place on an upper garment at the time of producing the same, and a method for producing an upper garment, and more particularly, a method for setting and attaching a front button or front buttons and a waist pocket or waist pockets in well-balanced positions on men's/women's upper garments at the time of producing the same upper garment in accordance with a so-called custom-making or easy-order-making production system and a method for producing an upper garment in accordance with the production system, the front button(s) and waist pocket(s) of which are set and attached in well-balanced positions.

Herein, the word "easy-order-making" is an English word coined in Japan, which is derived from the terms "custom-make (or custom-made)" and "made-to-order", and the term "an easy-order-making production system" represents one of the methods of garment production in Japan. In the production system, product specifications and component or part specifications, which meet the needs of the consumers with ease, are predicted and the possible range of specifications is set and standardized. In accordance with the matters thus set and standardized, preliminary arrangements are made and as necessary the respective matters are combined, whereby the clothes are produced. Namely, the inherent specifications are decided together with the respective consumers, while showing the possible specifications range before the consumer and the respective clothes are made to order. The preliminarily set and standardized matters include, for instance: a specific clothes item such as jacket, pants, skirt, vest, coat or shirt, etc.; design, such as silhouette showings an image of clothes as a whole, and details, such as pocket, dart, seam, collar, the end portion of sleeve or similar, size of the respective details; type of body and its correction, such as several basic types of body and its correction in some places; grading some specifications (conditions for producing the clothes); materials of the right side of clothes to be used; parts such as buttons, etc.; and similar. After the above-mentioned matters are standardized, the desired clothes are produced on the basis of the standardized matters by an assembly production line to provide the ordered clothes.

The term "upper garment" includes: a jacket; coat; and vest. The term "jacket" includes: a suit jacket; and a spare or odd jacket, such as blazer and sports jacket.

2. Description of the Related Art

Conventionally, in the case of producing men's/women's upper garment, for instance, a woman's jacket, to the order of a customer, there are several processes in the course between the initial order and the final product. Firstly, to grasp the needs of the customer and to give advice on selecting a fabric. Then, consulting design books, etc., to advise the customer on an appropriate jacket image from the fabric selected and the customer's proportions. Finally, to design a desired jacket.

The major matters to consider in jacket designing include: selection of garment length (for example, short length, semi-short length, medium length, semi-long length, and similar); selection of design for the portion from the center closing or front breasting portion through the lower edge for the jacket, i.e. front cut design (for example, tailored cut, round cut, slant cut, square cut, single-breasted, double-breasted, the number of buttons, etc.); selection of detail design (for example, lapels, pockets, etc.), and similar. Advising the customer on the above-mentioned matters and giving consideration to the entire silhouette are also matters to be considered.

Herein, the term "garment length" shall mean the length from the center back of the neck line, or from the nape of the neck down the center back, to the lower edge for an upper garment (i.e., jacket, coat, vest, etc.).

Thereafter, in accordance with the measuring guide, the size is taken from actual measurement of a customer's nude body with consideration of the physical features, such as proportions and type of body. After measuring, an appropriate bust pattern size is selected, and in order to make correction based on the bust pattern size, necessary fine-adjustment on the pattern is performed while advising the customer. Then, after imaging the ordered product as a whole, i.e. total looking, and checking up with the order, sewing follows and the desired product is made. Finally, advice to the customer on manners of wearing is given as the ending process, which is followed by after-sales service.

In the case of men's upper garments, a fine-adjustment on the pattern is necessary in the same manner as in the women's upper garments because the type of body etc. is different by the individual body as in that of women.

Generally speaking, both in men's and women's wear, there are the needs for a jacket of desired garment length, independently on their height and type of body, i.e. the needs of desired garment length all over the garment length.

However, in the course of conventional easy-order-making and custom-making production systems from the initial order of a jacket to the ending process, especially in the process of jacket designing, it has been difficult to make a jacket of every length form short through long with well-balanced positions of front buttons and waist pockets, while responding to the needs of garment in its full or entire length which are more particular in women's wear, and maintaining a waist shape position for the jacket. This is because, in the conventional easy-order-making and custom-making production system, setting and attaching of the positions of front buttons and waist pockets are based on the garment length, and thus when the jacket length is made longer, the positions of V-zones under the front neck, the front buttons and the waist pockets are simultaneously lowered to make the entire image too long, whereby the positions of the buttons and pockets are imbalance, and when the jacket length is made shorter, the positions of front buttons and waist pockets make the entire image too short, whereby the positions are imbalance.

For example, in the conventional method of adjusting the garment length, adjusting the garment length longer or short than a certain garment length is performed without changing the position of the waist shape, regardless of increase and decrease of the length, and there is no range of change or alteration for the waist shape position which corresponds to the angle of adjustment of garment length. A range of change for the top button position (V-zone) as been set a 1 to 2 increase and decrease (0.5 cm per 1 cm of the adjustment of garment length) of the adjustment range of garment length, a range of change for the bottom button position has been set at ½ increase and decrease of the adjustment range of garment length in accordance with the top button position, and a range of change for waist pockets positions has been set as ⅓ increase and decrease (0.33 cm per 1 cm of the adjustment of garment length) of the adjustment range of garment length. Since no change of the position of waist shape has been performed regardless of increase and decrease of the garment length, it has been difficult to keep the balance among positions of buttons and waist pockets, when the change is required.

Hence, the development of jackets which have the capability to correspond not only to the balance of height and center back waist length, but also to enough waist line silhouettes, the front buttons and waist pockets of which are set and attached in well-balanced positions on the jackets, has been craved for. Herein, the term "center back waist length" shall mean a measurement from the back center of the neck line of an upper garment, or from the nape of the neck down the center back, to the waist line (hereinafter as referred to "back length line") for the upper garment.

Furthermore, in order to acquire well-balanced positions of front buttons and waist pockets which match with a customer's design image, it has been craved for to be capable of properly adjusting these positions as desired so as to meet the needs of customers.

SUMMARY OF THE INVENTION

Accordingly, it is an object of the present invention to provide a method for setting and attaching a front button or front buttons and a waist pocket or waist pockets in well-balanced positions while maintaining the position of waist shape for men's/women's upper garments in the production of the upper garments of every kind of length, to meet the needs of men and women as mentioned above.

It is another object of the present invention to provide a method for producing a men's/women s upper garment with a front button or front buttons and a waist pocket or waist pockets set and attached in well-balanced positions according to the setting and attaching method as mentioned above.

In accordance with an aspect of the present invention, there is provided a method for setting and attaching a front button or front buttons and a waist pocket or waist pockets in place when producing men's/women's upper garments of every kind of length to an order of a customer in which the front button(s) and waist pocket(s) are set and attached in well-balanced positions while maintaining a position of waist shape, wherein the front buttons and waist pockets are set and attached in the well-balanced positions by defining an upper part of the back length line (i.e. waist line) as the center back waist length and its lower part as the hip length (below waist) respectively and reflecting a value of the center back waist length in pattern design setting and attaching a top one of the front buttons in a position a prescribed length above the back length line according to the value of the center back waist length or a prescribed length below the back length line according to a value of the hip length and setting and attaching a bottom one of the front buttons and the waist pockets in positions a prescribed length below the back length line according to the value of the hip length.

It is preferable that the above-mentioned method for setting and attaching the front button(s) and waist pocket(s) in place is utilized in case of a so-called easy-order-making production system of men's/women's upper garments.

It is preferable that in the women's upper garment, the center back waist length ranges from 34 cm to 45 cm and the hip length ranges from 15 cm to 38 cm. It is also preferable that the top button is set and attached in the position 1.5 cm through 14.0 cm above the back length line, or parallel to or 3.0 cm above the waist pockets which are positioned below the back length line, the bottom button is set and attached in the position 7 cm through 10.5 cm below the back length line according to the value of the hip length and the waist pockets are set and attached in the positions 4.5 cm through 6.5 cm below the back length line according to the value of the hip length.

In accordance with an another aspect of the present invention, there is a method for producing men's/women's upper garments of every kind of length to the order of a customer, in which a front button or front buttons and a waist pocket or waist pockets are set and attached in well-balanced positions while maintaining a position of waist shape, which comprises defining an upper part of back length line as a center back waist length and its lower part as a hip length (below waist) respectively and retiecting a value of the center back waist length in a pattern design, setting and attaching a top one of the front buttons in a position a prescribed length above the back length line according to the value of the center back waist length or a prescribed length below the back length line according to a value of the hip length, and setting and attaching a bottom one of the front buttons and the waist pockets in positions a prescribed length below the back length line according to the value of the hip length, and producing the upper garment in accordance with a publicly-known method.

It is preferable that the method of production of the men's/women's upper garment as mentioned above is performed in accordance with a so-called easy-order-making production system.

Furthermore, in accordance with a further aspect of the present invention, there is provided another method for setting and attaching a front button or front buttons and a waist pocket or waist pockets in place, which comprises setting and attaching the front buttons slid waist pockets in well-balanced positions while maintaining a position of a waist shape when producing men's/women's upper garments of every kind of length in accordance with the easy-order-making production system on the basis of a measurement sheet which is composed of a sales data area, a design area, a measurement area, a correction area, a module area and a fabric area, in which master positions of the front buttons and waist pockets are set by defining an upper part of back length line as a center back waist length and its lower part as a hip length (below waist) respectively and reflecting a value of the center back waist length in a pattern design, setting a top one of the front buttons in a position a prescribed length above the back length line according to the value of the center back waist length or a prescribed length below the back length line according to a value of the hip length, and setting a bottom one of the front buttons and the waist pockets in positions a prescribed length below the back length line according to the value of the hip length, and then, when the master positions of the front buttons and waist pockets do not meet a balanced design image of a customer, and order to make the master positions hither or lower, the positions of the front buttons and waist pockets are reset and attached in well-balanced positions, which meet the design images by indicating at word "Higher" or "Lower" and a value of up/down from the master positions respectively in sections of the top button position, bottom button position and waist pocket positions of the part of balance matters contained in the correction area of the measurement sheet. In this case, it is preferable that the ranges of center back waist length and hip length, and the positions of top button, bottom button and waist pockets to be set are the same as mentioned above. It is also preferable that the value of up/down from the master positions of front buttons and waist pockets ranges from 1 cm to 3 cm.

Furthermore, in accordance with yet a further aspect of the present invention, there is provided another method for producing men's/women's upper garments of every kind of length in accordance with a so-called easy-order-making production system based on a measurement sheet which is composed of a sales data area, a design area, a measurement area, a correction area a module area and a fabric area, in which a front button or front buttons and a waist pocket or waist pockets are set and attached in well-balanced positions while maintaining the position of a waist shape, wherein master positions of the front buttons and waist pockets are set by defining an upper part of back length line as a center back waist length and a lower part thereof as a hip length (below waist) respectively and reflecting a value of the center back waist length in a pattern design, setting a top one of the front buttons in a position a prescribed length above the back length line according to the value of the enter back waist length or a prescribed length below the back length line according to a value of the hip length, and setting a bottom one of the front buttons and the waist pockets in positions a prescribed length below the back length line according to the value of the hip length, and then, when the master positions of the front buttons and the waist pockets do not meet a balanced design image of a customer, and in order to make the master positions higher or lower, new positions of front buttons and waist pockets to be attached are resent in well-balanced positions, which meet a design image, by indicating a word "Higher" or "Lower" and a value or up/down from the master positions respectively in sections of the top button position, bottom button position and waist pocket positions of balance matters contained in the correction area of the measurement sheet, and the upper garment with well-balanced positions of front buttons and waist pockets which meet the design image of the customer is produced in accordance with a publicly-known method. In this case, it is preferable that the ranges of center back waist length and hip length, and the positions of top button, bottom button and waist pockets are the same as mentioned above. In addition it is preferable that the value of up/down from the above-mentioned master positions of front buttons and waist pockets ranges from 1 cm to 3 cm.

According to the above-mentioned method of the present invention for setting and attaching a front button or front buttons and a waist pocket or waist pockets in place, different from a method of conventional technology of setting front buttons and waist pockets based on garment length, it is possible in the production of men's/women's upper garments to set front buttons and waist pockets in well-balanced positions by setting the top and bottom buttons and waist pockets in prescribed positions depending on a peculiar value of a center back waist length. i.e. a specified value of garment length which is composed of the upper part of a back length line as a center back waist length and the lower part as hip length (below waist).

Also, according to the method of producing the upper garment of the present invention, different from the case of conventional technology, since front buttons and waist pockets are set and attached in prescribed positions based on a peculiar garment length to produce men's/women's upper garments, it is possible to produce a men's/women's upper garment of every kind of length, the front buttons and waist pockets of which are set and attached il well-balanced positions while maintaining the position of a waist shape for the upper garments to thereby meet the needs for upper garments of short length through long length which match with a peculiar center back waist length.

Furthermore, according to the present invention, it is possible to provide a more well-balanced upper (garment which meets the design image of customer by adjusting the master-positions of front buttons and waist pockets.

Moreover, it is also possible to correspond to different waist line silhouettes (low waist line, high waist line) at the request of the consumer by varying the waist shape position.

As mentioned above, the back length line means the waist line and the position of waist shape means the position of waist shape for an upper (garment herein.

The foregoing and other objects and features of the present invention will be apparent from the following description.

DETAILED DESCRIPTION OF THE PREFERRED EMBODIMENTS

Figure 1A:
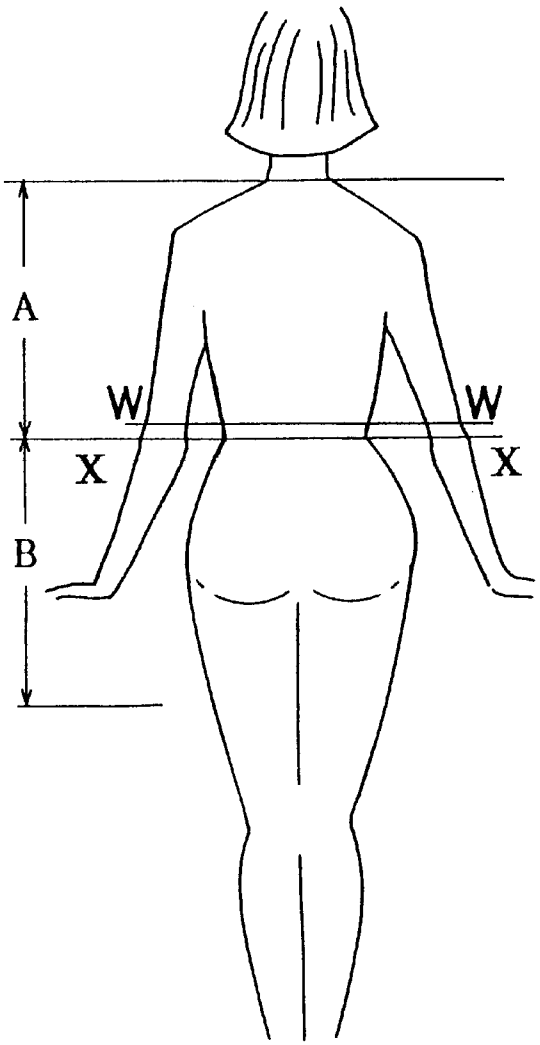
FIG. 1A is a back view of a jacket showing a jacket of every length produced in accordance with the present invention.

Next, referring to the accompanying drawings and taking a women s upper garment as all example, the embodiments of the present invention will be described as follows.

In the method for producing men's/women's upper garments, particularly women's upper garments, according to the present invention, it is possible in a so-called easy-order-making and custom-making production system of the women's upper garment to produce a jacket, coat and vest of short length, semi-short length, medium length, semi-long length and long length, the front buttons and waist pockets of which are set and attached in well-balanced positions while maintaining position of a waist shape for the upper garment, by reflecting the customer's center back waist length in a pattern design of a jacket, coat and vest, whereby it is possible to meet the needs of upper garment in its full length.

Setting of front buttons . . . , while maintaining a reference line at a waistline of a customer which is slightly below a waistline of a predetermined upper garment of any one of said men's and women's upper garments can be attained by attaching the top button (which is attached at the highest position) a prescribed length above and the bottom button (which is attached at the lowest position) a prescribed length below the back length line respectively, attaching the remaining buttons at regular intervals between the top and bottom buttons, and attaching waist pockets a prescribed length below the back length line.

The center back waist length to be specified in the easy-order-making production system of these women's upper garments preferably ranges from 34 cm to 45 cm, and this range is derived from the actual measurement of center back waist length and total length (size from the base of neck to heel) of 6,657 adult females and specified as preferable in consideration of objects of the present invention. According to the present invention, it is possible to set and attach front buttons and waist pockets of a jacket, etc. in well-balanced positions based on this iantre of center back waist length by reflecting the range in pattern design of the jacket, etc., aid by accepting the range of center back waist length, it is possible to produce a women's upper garment with front buttons and waist pockets in well-balanced positions as desired, almost covering the side range of adult female's height, which ranges from about 130 cm to about 190 cm.

The reason of setting and attaching the preferable range of the center back waist length as 34 cm through 45 cm is because, if the center back waist length is less than 34 cm and more than 45 cm, the successive line of bust, armholes, breadth of shoulders, etc. is deformed and the whole balance of the positions of the front buttons and waist pockets cannot be kept in wearing. Of course, even if the center back waist length is beyond this range, it is still possible to maintain the balance by adjusting the positions of buttons and pockets within a proper extent to as to produce an upper garment as desired.

The range of garment length to be set is preferably the total sum of the above-mentioned specified center back waist length and the hip length (for example, 15 cm through 38 cm) which is the lower part of the garment length, and the garment length can vary freely within the range of 49 cm through 89 cm.

To meet the above-mentioned needs of short length through long length, the models of various garment length in connection with the center back waist length in the present invention, which are easily appreciable to customers, are shown in Table 1 as follows:

TABLE 1

| Models of garment length | Standard of garment length |
|---|---|
| Short (S) | Back length + 15 cm < |
| Semi-Short (SS) | Back length + 20 cm < |
| Medium (M) | Back length + 24 cm < |
| Semi-Long (SL) | Back length + 29 cm < |
| Long (L) | Back length + 34 cm < |

As mentioned hereinafter, by setting the positions of the front buttons according to the above-mentioned center back waist length, it is possible to attain well-balanced positions of the front buttons and an appropriate V-zone around the neck, and by setting the positions of waist pockets according to the above-mentioned center back waist length, it is possible to attain well-balanced positions of the waist pockets.

Also, in accordance with the present invention, different from the production of a jacket in conventional technology where the setting of front buttons and waist pockets is based on a garment length as defined in the prior art, it is possible to meet the needs of short length through long length and waist line silhouette (low waist, high waist) which match with a peculiar center back waist length, since the front buttons and waist pockets are set in place according to the center hack waist length, i.e. to the garment length which is composed of the upper part of back length line as a center back waist length and its lower part as hip length respectively and by reflecting the garment length thus composed in a pattern design.

That is, in adjustment of the garment length in the present invention, provided that the center back waist length ranged from 34 cm to 45 cm and the hip length ranges from 15 cm to 38 cm, even if the garment length is adjusted longer or shorter than a certain garment length, the weight shape is positioned about 2.5 cm above the back length line in every center back waist length and no alteration of the waist shape position is made in connection with the range of adjustment of the garment length, i.e. the waist shape position does not change regardless of the adjustment of the garment length. Also, the position of top button (V-zone) is set depending on the center back waist length and no alteration is made in connection with the adjustment of the garment length, and the alteration of the position of a bottom button is calculated by the following expression:

{(Position of bottom button is longest hip length below waist)−(Position of bottom button is shortest hip length below waist)}÷{(Longest hip length below waist)−(Shortest hip length below waist)} and has an increase and decrease of 0.15 cm per 1 cm of the garment length adjustment: and the alteration of the position of waist pockets is calculated by the following expression:

{(Position of waist pocket in longest hip length below waist)−(Position of waist pocket in shortest hip length below waist)}÷{(Longest hip length below waist)−(Shortest hip length below waist)} and has an increase and decrease of 0.08 cm per 1 cm of the garment length adjustment. When the positions of the buttons and waist pockets are altered and set in place, while maintaining the position of a waist shape, alteration is very slight and the balance is well kept.

Returning now to the accompanying drawings, the positions of front buttons and waist pockets to be set and attached in the present invention will be described as follows.

Figure 1B:
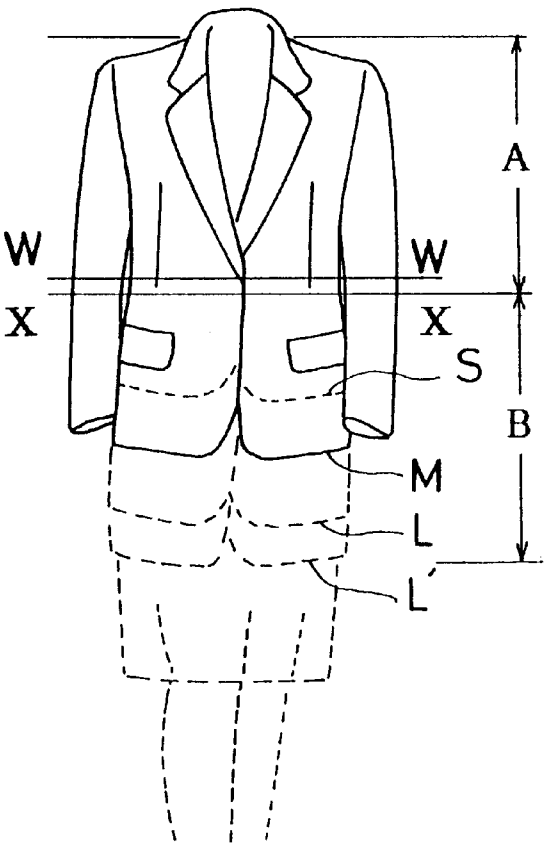
FIG. 1B is a front view of a jacket showing a jacket of every length produced in accordance with the present invention.
Figure 1C:
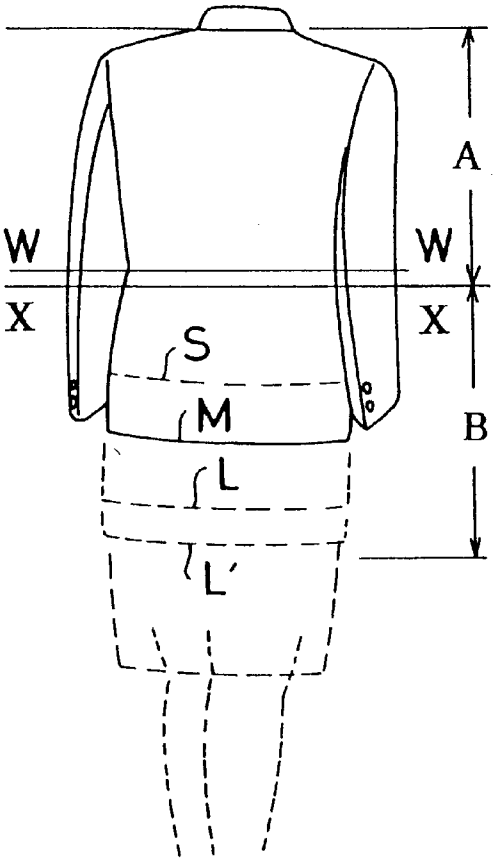
FIG. 1C is a back view of a human body showing positions of back length line and waist shape in the present invention.

FIGS. 1A. B and C show the models of a jacket in different garment length (S. M. L and L') which is produced according to the present invention, in which FIG. 1A shows a back view of the jacket, FIG. 1B shows a front view of the jacket, and FIG. 1C is a back view of a human body model which indicates the back length line (i.e. the waist line) and the waist shape position for the jacket. In these drawings, A denotes the center back waist length. B denotes the hip length below the waist, a line W—W denotes the waist shape position of jacket and a line X—X denotes a position of the back length line, i.e. the waist line of body. A+B constitute the garment length. In FIGS. 1A and B, S. M, L and L' indicate short length, medium length, long length and longer length than the long length, respectively.

Figure 2:
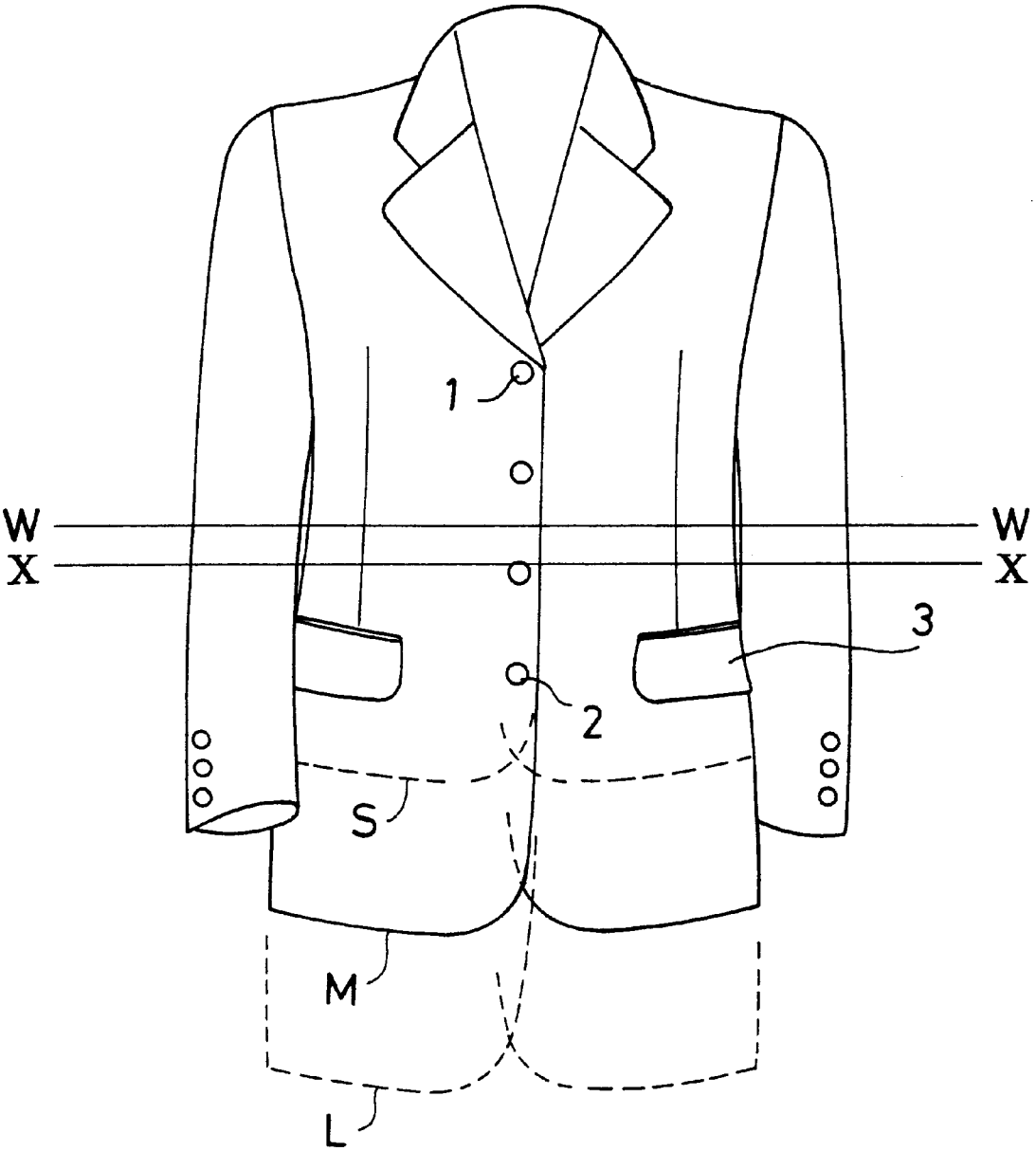
FIG. 2 is a front view of a women's jacket with well-balanced front buttons and waist pockets set and attached in accordance with a method of the present invention.

FIG. 2 shows a front view of tailored jacket with four front buttons and two waist pockets which is produced according to the present invention, and in the drawing, a solid line represents the jacket with the garment length being medium length (M) and dotted lines show the jacket with the garment length being short length (S) and long length (L). Respectively. Lines W—W and X—X in FIG. 2 are the same as those in FIG. 1.

As shown in FIGS. 1 and 2, the front top button (the first button) 1 is set on and attached at the position a certain length above the back length line X—X, according to the number of buttons. The first button of tailored jackets with two and three buttons is set on and attached to the position a certain length above the back length lines X—X, according to the number of buttons regardless of single-breasted or double-breasted. For example, it is set on and attached to about 1.5 cm above the back length line the in case of the tailored jacket with two buttons, and about 9.5 cm above the back length line in case of the tailored jacket with three buttons, respectively. In a tailored jacket with four buttons which is available only in single-breasted, its first button is set on and attached at about 14.0 cm above the back length line X—X. In a tailored jacket with one button and with single-breasted, the button is set on and attached at a certain length below the back length line X—X, depending on the hip length. For example, when the hip length is 15 cm~16 cm, 17 cm~19 cm, 20 cm~23 cm, 24 cm~0 cm and 31 cm~38 cm, the button is respectively set on and attached at 1.5 cm, 2.0 cm. 2.5 cm, 3.0 cm, and 3.5 cm below the back length line X—X. The respective positions are about 3.0 cm above the positions of waist pockets as mentioned hereinafter. In case oft a double-breasted jacket with one button, the button is set on and attached to the position parallel to those of waist pockets.

In case of a round neck jacket, the first button is set on and attached at the position a certain length, which is depending on the center back waist length and about 8 cm less than the center hack waist length, above the back length line X—X, regardless of single- or double-breasted and the number of buttons (4~5 buttons). This position of the first button is usually equivalent to 2.0 cm below the bottom of the front portion of round neckline.

Also, positions of the front bottom button and waist pockets are varied in proportion to the difference of {(garment length)−(center hack waist length)}, i.e. the hip length below the waist, regardless of tailored or round neck jacket, single- or double-breasted jacket, and the number of buttons, and if the hip length is made longer, the length between the back length line X—X and positions of the bottom button 2 and waist pocket 3 becomes longer.

The front bottom button is, for example, when the hip length is 15 cm 16 cm, 17 cm~19 cm, 20 cm~23 cm, 24 cm~26 cm, 27 cm~30 cm, 31 cm~33 cm, 34 cm~36 cm and 37 cm~38 cm, set on and attached at 7.0 cm, 7.5 cm, 8.0 cm, 8.5 cm, 9.0 cm, 9.5 cm, 10.0 cm and 10.5 cm below the back length line X—X, respectively.

Waist pockets are set on and attached at a certain length below the back length line X—X, as in the case of the front bottom button. For example, when the hip length is 15 cm~16 cm, 17 cm~19 cm, 20 cm~23 cm, 24 cm~30 cm and 31 cm~38 cm, they are respectively set on and attached at 4.5 cm, 5.0 cm, 6.0 cm and 6.5 cm below the back length line X—X.

The positions of top and bottom buttons and waist pockets, which are set and attached according to the back length line, are shown in table 2 as follows. By setting the positions in consideration of the balance beforehand, there is no need for being conscious of the size and design at the time of grading. In Table 2, unless otherwise indicated, all units are in "cm".

TABLE 2

| (Garment length − (Center back waist length) = (Difference) | 15~16 | 17~19 | 20~23 | 24~26 | 27~30 | 31~33 | 34~36 | 37~38 |
|---|---|---|---|---|---|---|---|---|
| Waist pocket | 4.5 below | 5.0 below | 5.5 below | 6.0 below | | | 6.5 below | |
| Single-breasted/ 1 button | 1.5/ below | 2.0 below | 2.5 below | 3.0 below | | | 3.5 below | |
| Double-breasted/ 1 buttoned-up | Same position as waist pocket | | | | | | | |
| Bottom button | 7.0 below | 7.5 below | 8.0 below | 8.5 below | 9.0 below | 9.5 below | 10 below | 10.5 below |
| Single-breasted/ 2 buttons/ 1st button | 1.5 cm above the back length line | | | | | | | |
| Double-breasted/ 2 buttoned-up | | | | | | | | |
| Single-breasted/ 3 buttons/ 1st button | 9.5 cm above the back length line | | | | | | | |
| Double-breasted/ 3 buttoned-up | | | | | | | | |
| Single-breasted/ 4 buttons/ 1st button | 14.0 cm above the back length line | | | | | | | |
| Round neck/ 1st button | 2.0 cm below the bottom of front portion of the round neck | | | | | | | |

As to the distance between buttons if the hip length is made longer, the distance between the top and bottom buttons (hereinafter referred to as total distance) becomes longer since the position of bottom button is varied or altered in proportion to the hip length. The distance between adjacent buttons is calculated by (the total distance)/{(the number of buttons)−1}.

The position of the waist shape for jacket, W—W, is about 2.5 cm above the back length line of X—X, regardless of tailored jacket or round neck jackets single- or double-breasted jacket and the number of buttons. Hence, in case of the same center hack waist length (for example, as in case of the same customer), the same waist shape position can be maintained regardless of the garment length.

Designated values to set the positions of the front buttons and waist pockets as mentioned above are called "master values or master positions" herein. In the case that the master values do not meet the customer's request, the master values can be adjusted within a prescribed range, as mentioned hereinafter and shown in FIGS. 3A. B, C and FIG. 4A, B. C. Such adjustment is made without any imbalance of positions of the front buttons and waist pockets.

In the present invention, the front buttons and waist pockets are positioned and attached on the basis of the concept of a center back waist length as mentioned above. Adjustment of these positions is performed on the basis of balance matters contained in the correction ares (FIG. 3B) of the measurement sheet (FIG. 3A) so as to thus provide a balanced upper garment much closer is a design image of the customer.

Adjustment of the master positions of the front buttons can be generally performed and attained by altering the position 1 cm~3 cm upward or downward from the position initially set in case of the top button position to set a new position higher or lower, and altering the position 1 cm~3 cm upward or downward from the position initially set in case of the bottom button position to set a new position higher or lower. Adjustment of the master positions of the waist pockets can be generally performed and attained by altering the positions 1 cm~3 cm upward or downward from the position initially set in case of the waist pockets positions to set a new position higher or lower. Detailed description of the preferred embodiments of these adjustment will be made as follows.

Adjustment of the master positions of front buttons is preferably performed and attained by altering the positions of the top and bottom buttons from the positions initially set, according to the type of front (i.e. single-breasted or double-breasted) and the number of buttons, in the part of the balance matters, as described below.

Namely, as to the position of top button of a tailored jacket, in case of single-breasted with two buttons, single-breasted with four buttons and double-breasted with two buttoned-up, when the given center back waist length is 35 cm, 36 cm and 37 cm and more, it is possible to adjust the position by altering the position at most 1 cm, 2 cm and 3 cm upward, respectively from the position initially set. When the center back waist length is less than 34 cm, however altering the position upward makes an imbalance in positions of the buttons. In case of a tailored jacket of single-breasted with one button, single-breasted with three buttons, double-breasted with three buttoned-up and double-breasted with one buttoned-up, it is possible to adjust the position of the top button by altering the position at most 3 cm upwards regardless of the value of the center back waist length. In case of a round neck jacket, in order to maintain the front neck line, it is possible to adjust the top button position by altering the position at most 1 cm upward, regardless of the value of the center back waist length. The downward movement of the top button is at most 3 cm in the case of a tailored jacket and at most 2 cm in the case of a round neck jacket, regardless of the center back waist length.

The upward alteration of the bottom button from the position initially set, i.e. the master position, is at most 3 cm both in case of a tailored jacket and a round neck jacket, regardless of the hip length. The downward alteration of the bottom button from the position initially set. i.e. the master position, is at most 1 cm, 2 cm and 3 cm, respectively, both in case of a tailored or round neck jacket, when the hip length is 16 cm, 17 cm and 18 cm and more.

Adjustment of the master positions of waist pockets is preferably attained in the following mainer. Regardless of the hip length, it is possible to adjust the master positions by altering the positions at most 3 cm upward from the positions initially set, and it is possible to adjust the master positions by altering the positions at most 1 cm, 2 cm and 3 cm downward, respectively, when the given center back waist length is 35 cm, 36 cm and 37 cm and more. When the center back waist length is less than 34 cm, however, altering the positions downward makes an imbalance in the positions of the waist pockets. Besides, in case of a shorter length jacket, the downward alteration is adjusted case of a shorter length jacket, the value of downward alteration is adjusted according to the hip length, so as not to deform the image of the front in the jacket.

Figure 3A:
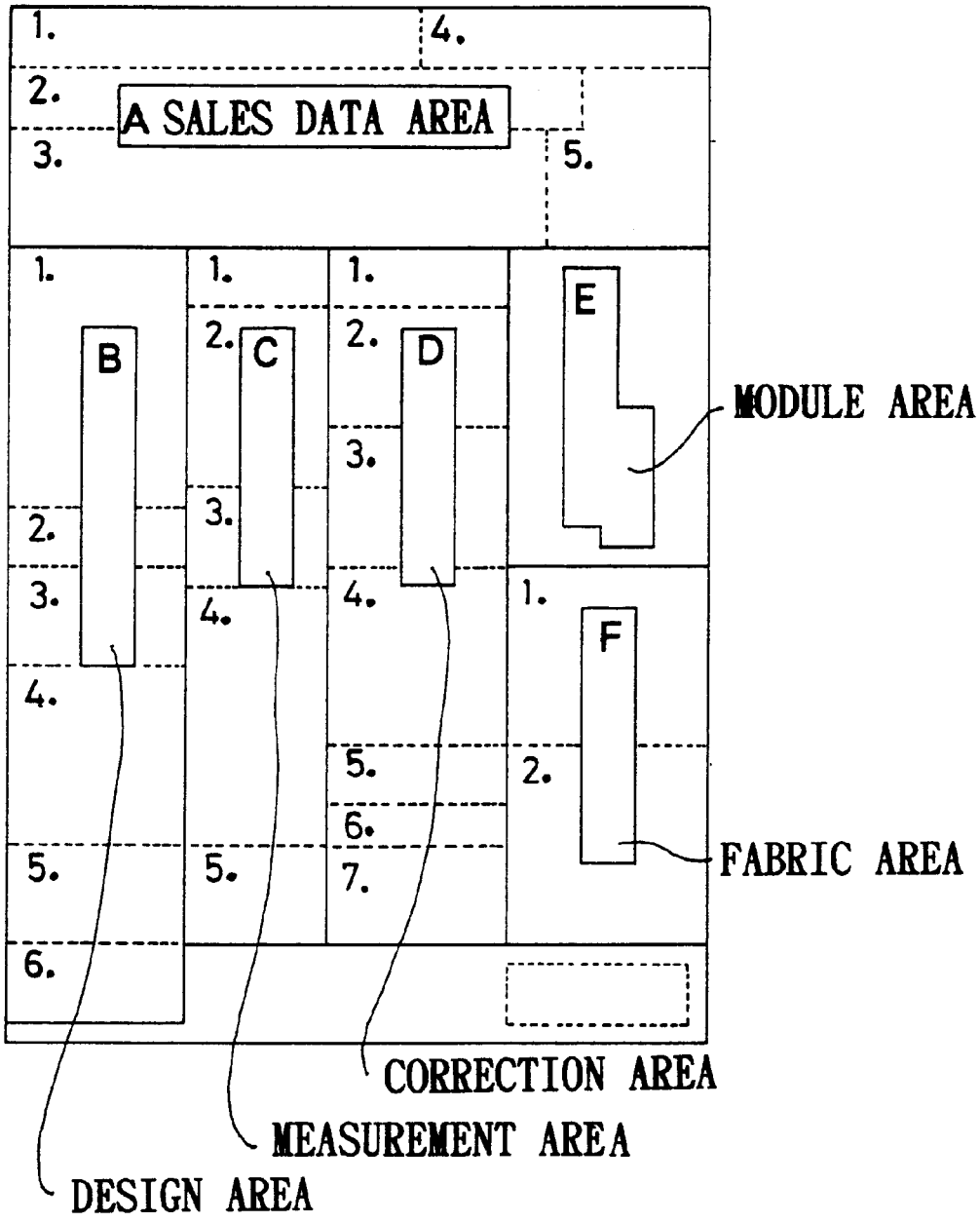
FIG. 3A is a schematic drawing showing the construction of a measurement sheet which is utilized in production of the upper garment, particularly in arrangement of the positions of front buttons and waist pockets in accordance with the present invention.

Above-mentioned adjustment is performed and attained by, for example, as shown in FIGS. 3A and B, indicating a word "Higher" when the master positions are altered upward or a word "Lower" when the master positions are altered downward and selecting one from "1.0 cm, 2.0 cm, 3.0 cm" for the value of up/down from the master positions, in the sections of top button position, bottom button position and waist pocket position of the part of balance matters contained in the correction area of the measurement sheet.

Figure 3B:
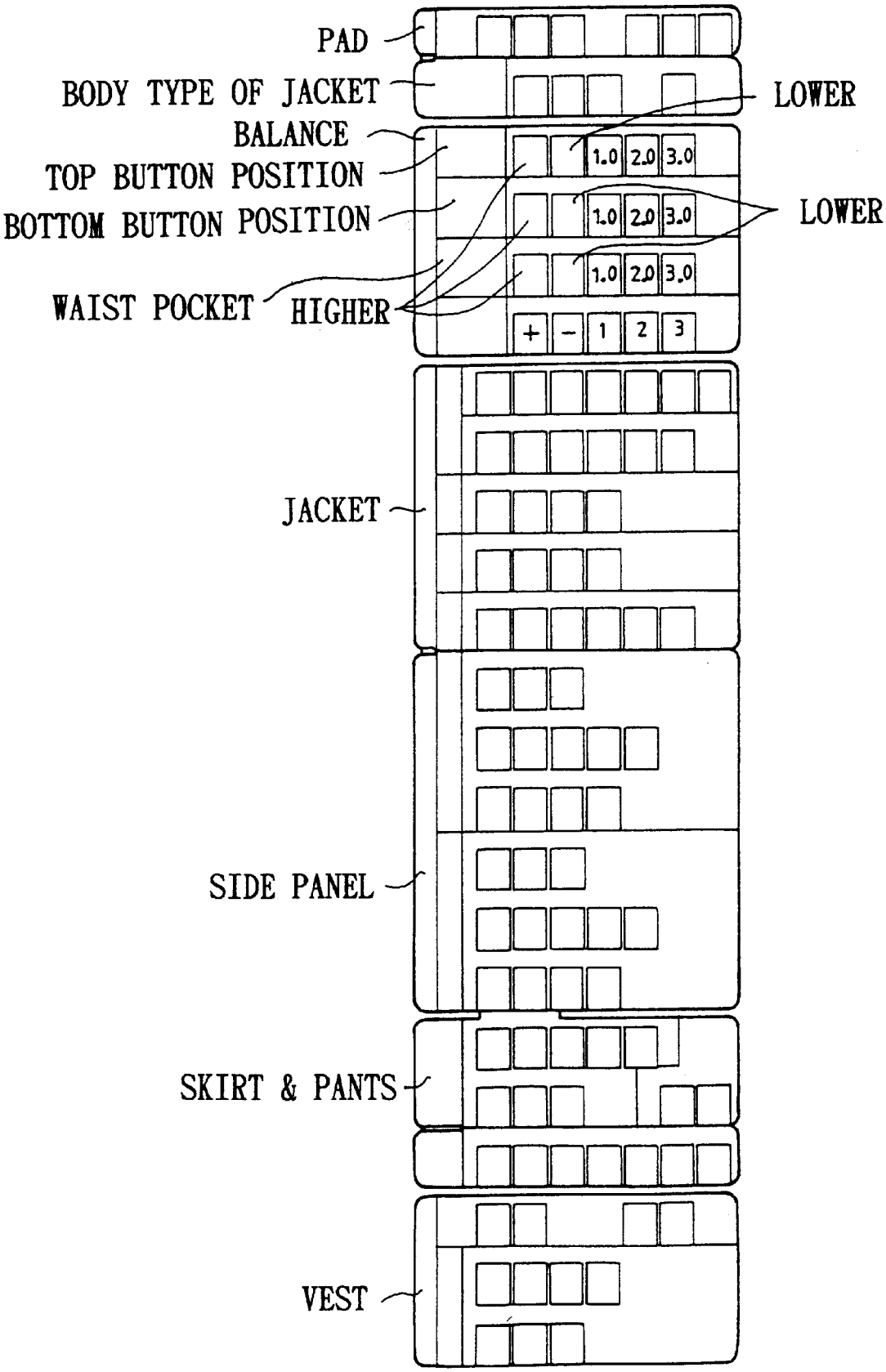
FIG. 3B is an enlarged view showing the construction of a correction area which is a part of the measurement sheet shown in FIG. 3A.

The measurement sheet shown in FIG. 3A is suitably composed of a sales data area, a design area, a measurement area, a correction area, a module area and a fabric area, and the correction area shown in FIG. 3B is suitably composed of parts of pad, body type of jacket, balance, jacket, side panel vest and the like. Among these, the part of balance is composed of the sections of top button position, bottom button position and waist pocket position. In FIGS. 3A and B, portions which are not necessary for adjustment in the present invention are not shown in detail.

Figure 4A:
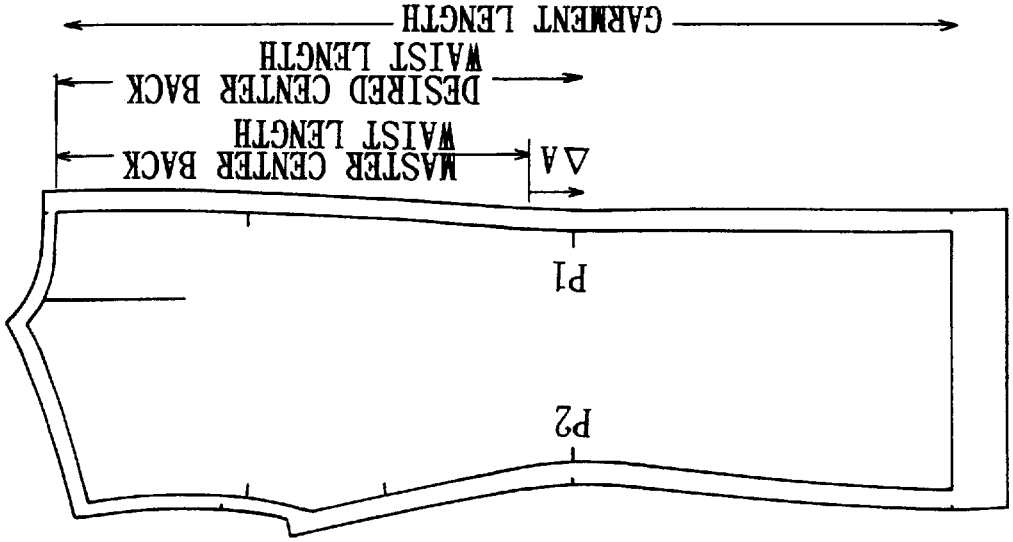
FIG. 4A is a plan view of a back body pattern for the upper garment which shows setting of positions of buttons and waist pockets in accordance with the present invention.

Next, referring to FIGS. 4A. B and C, an automatic method to set the positions of front buttons and waist pockets based on the garment length will be described.

Figure 4B:
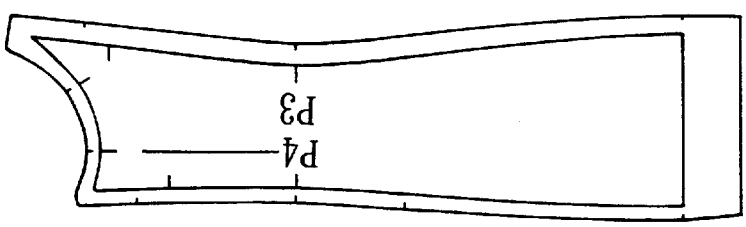
FIG. 4B is a plan view of a side body pattern for the upper garment which shows setting of positions of buttons and waist pockets in accordance with the present invention.
Figure 4C:
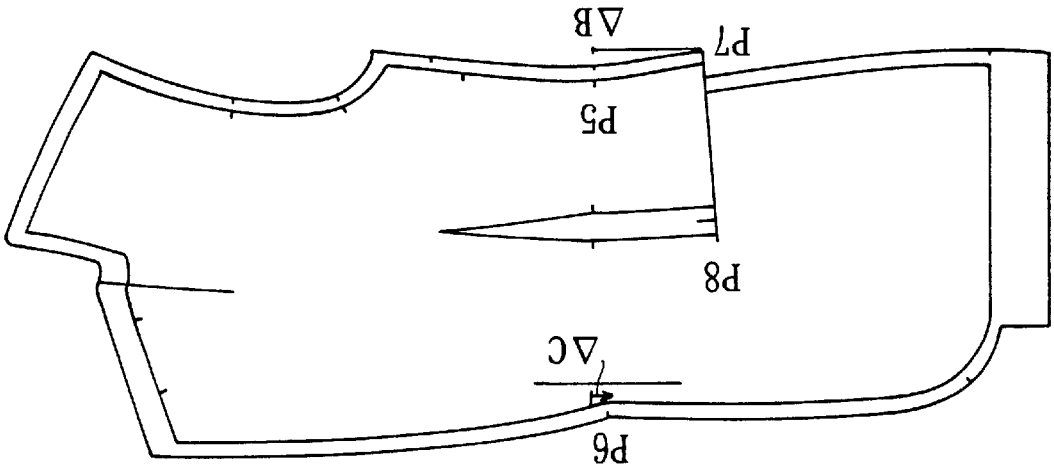
FIG. 4C is a plan view of a front body pattern for the upper garment which shows setting of positions of buttons and waist pockets in accordance with the present invention.

As can be seen from the patterns of back body, side body and front body, which are shown in FIGS. 4A, B and C respectively, the positions of buttons and waist pockets are atutomatically set according to the garment length by means of a grading operation. By the gradinig operation, it is possible to adjust the center back waist length according to the following expression: ΔA=(Desired center back waist length)—(Master center back waist length), i.e. the ccnter back waist length can be adjusted by moving or altering the master position to the corresponding respective points P1~P8 for the same value of ΔA, as shown in FIG. 4.

As to the positions of waist pockets, it is also possible to adjust the positions by moving or altering the master positions to points P7 and P8 for the same value of ΔB (ΔB=(Desired waist pocket positions)—(Master waist pocket positions)) from point P5 set by the size, design and the like as mentioned above. Furthermore, as to the positions of buttons, it is also possible to adjust the positions by moving or altering the master positions to point P6 for the value of ΔC (ΔC=(Desired button positions)—(Master button positions)) from point P5 set by the size. design and the like as mentioned above.

It is possible to provide a well-balanced upper garment which meets the design imaoe of customers by the aforementioned adjustment.

Furthermore, in case of men's upper garments, it is preferred that the center back waist length to be indicated or specified in the above-mentioned easy0order-making production system ranges from 38 cm to 51 cm, and it is preferred that the garment length to be set or specified in the production system ranges from 53 cm to 100 cm, The center back waist length and the garment length can be varied freely within the above range.

In the men's upper garment, it is possible to set and attach front buttons and waist pockets thereof in well-balanced positions based on the above ranges, in the same manner as described above in respect of the women's upper garment, and it is also possible to adjust the master positions of the front buttons and waist pockets within the range as desired.

EXAMPLES

Next, examples of the present invention will be described in greater detail by taking a women's jacket as an example and referring to the accompanying drawings.

Description is made for setting and attaching the positions of front buttons and waist pockets in producing a woman's jacket of a medium length model (38 cm in center back waist length and 24 cm in hip length below waist), as mentioned in Table 1 and shown in FIG. 2, and for the production of the jacket.

In producing the woman's jacket to order of a customer whose height was 158 cm, the needs of customer were determined and selection of a fabric was made upon giving advice to the customer. Then, after consulting design books and advising, the customer on an appropriate jacket image to the fabric selected and the customer's proportions, the medium length as garment length and the tailored cut (single-breasted with 4 buttons) as front cut design with two waist pockets as the gther desigin feature were selected in consideration of the entire silhouette.

Thereafter, according to a measuring guide, the size was taken from actual measurement of a nude body with consideration of the physical features, such as proportions and type of body. In doing so, adjustment of the center back waist length, setting of well-balanced position of waist shape for the jacket, advising the customer on room for movement or alteration and size correction based on type of body and proportions, deciding the necessity of silhouette correction (the volume of shape and flare, adjustment of position(s) of a waist pocket or waist pockets, etc.), and reflecting the quality of chosen fabric on the size were performed. In this case, the top button I was set and attached 14 cm above the back length line X—X, and since the hip lengith was 24 cm, the bottom button 2 was set and attached 8.5 cm below the back length line X—X and the waist pockets were positioned and attached 6.0 cm below the back length line X—X. Thie distance between the adjacent buttons was 7.5 cm, The waist shape position W—W was 2.5 cm above the back length line X—X.

After measuringJ, an appropriate bust pattern size was selected, and correction based on the bust pattern size and necessary fine-adjustment on the pattern were made, and thereafter total checking of the order was performed. Then, sewing followed and the ordered product was made.

Also, according to the same method as mentioned above, a women's jacket and short length (38 cm in center back waist length and 15 cm in hip length) and that of long length (38 cm in center back waist length and 38 cm in hip length) were produced, while maintaining the waist shape position W—W as 2.5 cm above the back length line X—X. While the position of top button was the same as that of medium length in both cases, the bottom button was set and attached 7.0 cm below the back length line X—X in case of the short length and 10.5 cm below the back length line X—X in case of the long length, respectively. The waist pockets were set and attached 4.5 cm below the back length line X—X in case of the short length and 6.5 cm below the back length line X—X in case of the long length, respectively. The distance between the adjacent buttons was 7.0 cm in the short length and 8.17 cm in the long length, respectively.

In these three jackets eventually acquired, the waist shape position was propely maintained, and the front buttons and waist pockets were set and attached in well-balanced positions so as to fully meet the customer's needs.

Finally, advice to the customer on manners of wearing was given as the ending process, which was followed by after-sales service.

In the process of above-mentioned examples, if the balance of positions of front buttons and waist pockets does not satisfy the needs of customer, it is possible, as mentioned hereinbefore, to provide a garment which meets the customer's design image. by adjusting the balance of positions according to the direction of the balance matters as shown in FIGS. 3A and B.

Also, according to the above examples, it was possible to produce a coat and vest having well-balanced positions of front buttons and waist pockets based on the center back waist length, as desired.

Furthermore, in case of a man's upper garment, coat and vest, according to the same process as in the woman's garment, it was possible to provide the garments as desired, having well-balanced positions of front buttons and waist pockets, and the garments thus produced fully meet the customer's needs.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modification and equivalents as can be included within the spirit and scope of the claims appended hereto.

What is claimed is:

1. A method for setting and attaching at least one front button and at least one waist pocket in place when producing any one of men's and women's upper garments to a customer specified length, in which said at least one front button and said at least one waist pocket are set and attached in adjusted positions with respect to a reference line at a waistline of a customer which is slightly below a waistline of a predetermined upper garment of any of said men's and women's upper garments, said method comprising the steps of:

defining a reference line as a back length line which is at said waistline of said customer, wherein (i) an upper part of said predetermined upper garment of any one of said men's and women's upper garments extends from said back length line to a neckline of said customer, said upper part having a length entitled a center back waist length, and (ii) a lower part of said predetermined upper garment of any one of said men's and women's upper garments extends from said back length line to a bottom length of said upper garment, said lower part having a length entitled a hip length;

setting and attaching a top button of said at least one front button in a position any one of (i) a predetermined length above said back length line according to a value of said center back waist length and (ii) a predetermined length below said back length line according to a value of said hip length; and setting and attaching a bottom button of said at least one front button and said at least one waist pocket in positions a predetermined length below said back length line according to said value of said hip length.

2. The method for setting and attaching at least one front button and at least one waist pocket in place as defined in claim 1, wherein in any one of said women's upper garments, said center back waist length ranges from 34 cm to 45 cm and said hip length ranges firom 15 cm to 38 cm.

3. The method for setting and attaching at least one front button and at least one waist pocket in place as defined in claim 1, wherein in any one of said women's upper garments, said center back waist length ranges from 34 cm to 45 cm and said hip length ranges from 15 cm to 38 cm.

4. The method for setting and attaching at least one front button and at least one waist pocket in place as defined in claim 1, wherein said top button is set and attached in any one of (i) a position 1.5 cm through 14.0 cm above said back length line, (ii) a position parallel to said at least one waist pocket which is positioned below said back length line, and (iii) a position 3.0 cm above said at least one waist pocket which is positioned below said back length line.

5. The method for setting and attaching at least one front button and at least one waist pocket in place as defined in claim 1, wherein said bottom button is set and attached in a position 7 cm through 10.5 cm below said back length line according to a value of said hip length.

6. The method for setting and attaching at least one front button and at least one waist pocket in place as defined in claim 1, wherein said at least one waist pocket are set and attached in positions 4.5 cm through 6.5 cm below said back length line according to a value of said hip length.

7. The method for setting and attaching at least one front button and at least one waist pocket in place as defined in claim 1, wherein in any one of said women's upper garments, said center back waist length ranges from 34 cm to 45 cm and said hip length ranges from 15 cm to 38 cm, said top button is set and attached in anly one of a position 1.5 cm through 14.0 cm above said back length line, and any one of a position parallel to and 3.0 cm above said at least one waist pocket which are positioned below said back length line, said bottom button is set and attached in a position 7 cm through 10.5 cm below said back length line according to a value of a hip length, and said at least one waist pocket are set and attached in positions 4.5 cm through 6.5 cm below said back length line according to said value of said hip length.

8. A method for producing any one of men's and women's upper garments to a customer specified length, in which at least one front button and at least one waist pocket are set and attached in adjusted positions with respect to a reference line at a waistline of a customer which is slightly below a waistline of a predetermined upper garment of any one of said men's and women's upper garments, said method comprising the steps of:

defining an upper part of said predetermined upper garment of any one of said men's and women's upper garments as extending from said reference line, which is entitled a back length line, to a neck line of said predetermined upper garment, said upper part of said predetermined upper garment having a length entitled a center back waist length;

defining a lower part of said predetermined garment of any one of said men's and women's upper garments as extending from said reference line, which is entitled said back length line, to a bottom length of said predetermined upper garment, said lower part of said predetermined upper garment having a length entitled a hip length;

setting and attaching a top button of said at least one front button in any one of (i) a position a predetermined length above said back length line according to a value of said center back waist length and (ii) a position a predetermined length below said back length line according to a value of said hip length;

setting and attaching a bottom button of said at least one front button and said at least one waist pocket in positions a predetermined length below said back length line according to said value of said hip length; and producing said predetermined upper garment of any one of said men's and women's upper garments.

9. A method for setting and attaching at least one front button and at least one waist pocket in place when producing any one of men's and women's upper garment of varying length, in which said at least one front button and said at least one waist pocket are set and attached in adjusted positions with respect to a reference line at a waistline of a customer which is slightly below a waistline of a predetermined upper garment of said men's and women's upper garments, and said predetermined upper garment is produced by an easy-order-making production system based on a measurement sheet which is composed of a sales data area, a design area, a measurement area, a correction area, a module area and a fabric area, said method comprising the steps of;

defining (i) an upper part of said predetermined upper garment of any one of said men's and women's upper garments as extending from said reference line, which is entitled a back length line, to a neckline of said predetermined upper garment, said upper part having a length entitled a center back waist length, and (ii) a lower part of said predetermined upper garment of any one of said men's and women's upper garments as extending from said back length line to a bottom length of said predetermined upper garment, said lower part having a length entitled a hip length;

setting a top button of said at least one front button in a master position any one of (i) a predetermined length above said back length line according to a value of said center back waist length and (ii) a predetermined length below said back length line according to a value of said hip length;

setting a bottom button of said at least one front button and said at least one waist pocket in master positions a predetermined length below said back length line according to said value of said hip length; and when said master positions of said at least one front button and said at least one waist pocket do not meet a design image of a customer, and in order to make said master positions higher or lower, resetting and attaching said at least one front button and said at least one waist pocket in corrected positions which meet said design image, the corrected position, for each of said master positions, being set a predetermined length any one of up and down from said each of said master positions according to correction values contained in said correction area of said measurement sheet.

10. The method for setting and attaching at least one front button and at least one waist pocket in place as defined in claim 9, wherein in any one of said women's upper garments, said center back waist length ranges from 34 cm to 45 cm and said hip length ranges from 15 cm to 38 cm.

11. The method for setting and attaching at least one front button and at least one waist pocket in place as defined in claim 9, wherein said top button is set in any one of a position 1.5 cm through 14.0 cm above said back length line, and any one of a position parallel to and 3.0 cm above said at least one waist pocket which are positioned below said back length line.

12. The method for setting and attaching at least one front button and at least one waist pocket in place as defined in claim 9, wherein said bottom button is set in a position 7 cm through 10.5 cm below said back length line according to a value of said hip length.

13. The method for setting and attaching at least one front button and at least one waist pocket in place as defined in claim 9, wherein said at least one waist pocket is set in positions 4.5 cm through 6.5 cm below said back length line according to a value of said hip length.

14. The method for setting and attaching at least one front button and at least one waist pocket in place as defined in claim 9, wherein in any one of said women's upper garments, said center back waist length ranges from 34 cm to 45 cm and said hip length ranges from 15 cm to 38 cm, said top button is set and attached in any one of a position 1.5 cm through 14.0 cm above said back length line, any one of a position parallel to and 3.0 cm above said at least one waist pocket which is positioned and attached below said back length line, and said bottom button is set and attached in a position 7 cm through 10.5 cm below said back length line according to a value of said hip length, and said at least one waist pocket is set in positions 4.5 cm through 6.5 cm below said back length line according to said value of said hip length.

15. The method for setting and attaching at least one front button and at least one waist pocket in place as defined in claim 14, wherein a value of any one of up and down from said masters positions of said at least one front button and said at least one waist pocket ranges from 1 cm to 3 cm.

16. A method for producing any one of men's and women's upper garments to a customer specified length by an easy-order-making production system based on a measurement sheet which is composed of a sales data area, a design area, a measurement area, a correction area, a module area and a fabric area, in which at least one front button and at least one waist pocket are set and attached in adjusted positions, while maintaining a reference line at a waistline of a customer which is slightly below a waistline of a predetermined upper garment of said men's and women's upper garments, said method comprising the steps of:

defining (i) an upper part of said predetermined upper garment extending above said reference line, which is entitled a back length line, said upper part of said predetermined upper garment having a length entitled a center back waist length, and (ii) a lower part of said predetermined upper garment extending below said reference line, said lower part of said predetermined upper garment having a length entitled a hip length;

setting a top button of said at least one front button in a master position any one of (i) a predetermined length above said back length line according to a value of said center back waist length and (ii) a predetermined length below said back length line according to a value of said hip length;

setting a bottom button of said least one front button and said at least one waist pocket in master positions a predetermined length below said back length line according to said value of said hip length;

when said master positions of said at least one front button and said at least one waist pocket do not meet a design image of a customer, and in order to make said master positions higher or lower, resetting and attaching said at least one front button and said at least one waist pocket in corrected positions which meet said design image, the corrected position for each of said master positions being a prescribed length any one of up and down from said each of said master positions according to correction values contained in said correction area of said measurement sheet; and producing said predetermined upper garment with adjusted positions of said at least one front button and said at least one waist pocket which meet said design image.

17. The method for producing any one of said men's and women's upper garments with said at least one front button and said at least one waist pocket in adjusted positions as defined in claim 16, wherein in any one of said women's upper garments, said center back waist length ranges from 34 cm to 45 cm and said hip length ranges from 15 cm to 38 cm, said top button is set in any one of (i) a position 1.5 cm through 14.0 cm above said back length line, (ii) a position parallel to said at least one waist pocket which is positioned below said back length line, and (iii) a position 3.0 cm above said at least one waist pocket which are positioned below said back length line, and said bottom button is set in a position 7 cm through 10.5 cm below said back length line according to a value of said hip length.

18. The method for producing any one of said men's and women's upper garments with said at least one front button and said at least one waist pocket in adjusted positions as defined in claim 16, wherein said value of up and down from said master positions of said at least one front button and said at least one waist pocket ranges from 1 cm to 3 cm.

19. The method for setting and attaching at least one front button and at least one waist pocket in place as defined in claim 5, wherein said top button of a tailored jacket with two buttons is set on and attached to 1.5 cm above said back length line, said top button of said tailored jacket with three buttons is set on and attached to 9.5 above said back length line, said top button of said tailored jacket with four buttons is set on and attached to 14.0 cm above said back length line and said top button of said tailored jacket with one button is, when a hip length is 15 cm~16 cm, 17 cm~19 cm, 20 cm~23 cm, 24 cm~30 cm, 31 cm~38 cm, set on and attached to 1.5 cm, 2.0 cm, 2.5 cm, 3.0 cm, and 3.5 cm below said back length line, respectively, and said top button of a round neck jacket is set on and attached to 8 cm less than said center back waist length.

20. The method for setting and attaching at least one front button and at least one waist pocket in place as defined in claim 6, wherein said bottom button is, when said hip length is 15 cm~16 cm, 17 cm~19 cm, 20 cm~23 cm, 24~26 cm, 27 cm~30 cm, 31 cm~33 cm, 34 cm~36 cm, and 37 cm~38 cm, set on and attached to 7.0 cm, 7.5 cm, 8.0 cm, 8.5 cm, 9.0 cm, 9.5 cm, 10.0 cm, 10.5 cm below said back length line, respectively.

21. The method for setting and attaching at least one front button and at least one waist pocket in place as defined in claim 7, wherein said waist pockets are, when said hip length is 15 cm~16 cm, 17 cm~19 cm, 20 cm~23 cm, 24 cm~30 cm, and 31 cm~38 cm, set on and attached to 4.5 cm, 5.0 cm, 5.5 cm, 6.0 cm and 6.5 cm below said back length line, respectively.

* * * * *